US005704077A

United States Patent [19]

Rodriguez

[11] Patent Number: 5,704,077

[45] Date of Patent: Jan. 6, 1998

[54] BIDET FITTINGS FOR WATER CLOSET

[76] Inventor: Otto M. Rodriguez, 8564 Timberlake Dr., Riverdale, Ga. 30296

[21] Appl. No.: 572,570

[22] Filed: Dec. 14, 1995

[51] Int. Cl.[6] ..... A47K 3/20

[52] U.S. Cl. ..... 4/420.4

[58] Field of Search ..... 4/420.4, 448

[56] References Cited

U.S. PATENT DOCUMENTS

| | | | |
|---|---|---|---|
| 3,015,826 | 1/1962 | Aranas | 4/420.4 |
| 4,242,764 | 1/1981 | Fukuda | 4/420.4 |
| 4,967,423 | 11/1990 | Aoyama | 4/420.4 |
| 5,025,510 | 6/1991 | Basile | 4/420.4 X |

FOREIGN PATENT DOCUMENTS

| | | | |
|---|---|---|---|
| 1115868 | 4/1956 | France | 4/420.4 |
| 0278628 | 11/1989 | Japan | 4/420.4 |

*Primary Examiner*—Charles E. Phillips
*Attorney, Agent, or Firm*—James B. Middleton

[57] ABSTRACT

Bidet fittings can be attached to an existing water closet to provide a combination water closet and bidet. A nozzle is placed at the front of the bowl of the water closet, and a delivery pipe extends around the bowl, under the rim. At the rear of the bowl, the delivery pipe wraps around the rim and emerges on the platform of the rear of the bowl. The delivery pipe is held in position under the rim by fasteners having an expandable anchor extending into holes in the rim of the water closet, with a strap extending around the delivery pipe. A tee fitting connects the delivery pipe to a water supply pipe; and, valves at each side of the platform allow control of water flow to the supply pipe by a person sitting on the seat of the water closet. Hot and cold water sources may be connected to the valves.

3 Claims, 1 Drawing Sheet

BIDET FITTINGS FOR WATER CLOSET

BACKGROUND OF THE INVENTION

1. Field of the Invention

This invention relates generally to bathroom fixtures, and is more particularly concerned with bidet fittings that are attachable to an existing water closet.

2. Discussion of the Prior Art

Bidets are common fixtures in some countries, but they are not found regularly in the United States. Since a bidet is not usually installed in a bathroom in this country, there is rarely a convenient location to install one in the event the owner wishes to have a bidet. Bathrooms are usually too small to accommodate the addition of a bidet, so one must omit the bidet, or make considerable alterations in the house.

In the past, there have been some combinations of bidets and water closets, basically the water closet having one, and sometimes more, water nozzles mounted in the bowl. Such water nozzles have frequently been mounted towards the rear of the bowl of the water closet where the nozzle will be in the waste stream. This is unacceptable from a sanitary standpoint. Even though the nozzle may be retractable, there is always the danger that someone will forget to retract the nozzle, and sanitation standards are not met. Other prior art provides bidet and water closet combinations, but provide the combination as originally manufactured, and do not provide for attachment of the bidet fittings after installation of the water closet. Such a fixture would require that a person replace the entire fixture in order to add a bidet to an existing bathroom.

SUMMARY OF THE INVENTION

The present invention provides bidet fittings to be added to an existing water closet. The bidet fittings include a nozzle at the front of the bowl, barely protruding from under the rim of the bowl of the water closet, so the nozzle is out of the waste stream, yet positioned for effective use. A delivery pipe extends around one side of the bowl, held in place by fastening means that grip existing openings in the water closet bowl. At the rear of the water closet bowl, the delivery pipe is connected to a water supply; and, the supply may include hot and cold water, or just cold water as desired. Valves for controlling the flow of water to the supply are provided at the rear of the water closet bowl where they can conveniently be reached by a user.

The present invention further includes a unique fastening means for fixing the delivery pipe to the water closet bowl.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
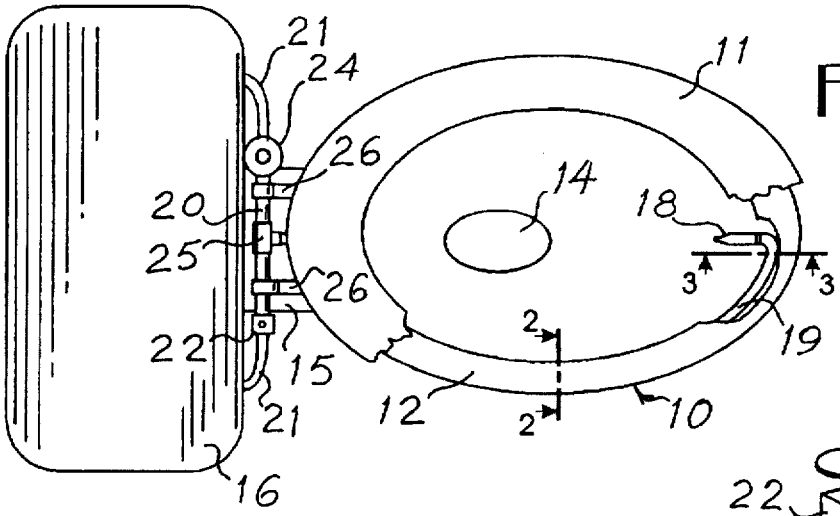
FIG. 1 is a top plan view of a water closet having the bidet fittings of the present invention installed thereon, portions being brokenaway to show the construction.

Referring now more particularly to the drawings and to that embodiment of the invention here presented by way of illustration, FIG. 1 shows a conventional water closet having a bowl 10 and a ring seat 11. The bowl 10 includes a rim 12, and a drain 14 in the bottom of the bowl 10. A platform 15 extends rearwardly and receives a water supply tank 16. Though not here illustrated, it will be understood that there will be some means to open a float valve in the tank 16 to allow the water to run into the bowl 10 for flushing.

Figure 5:
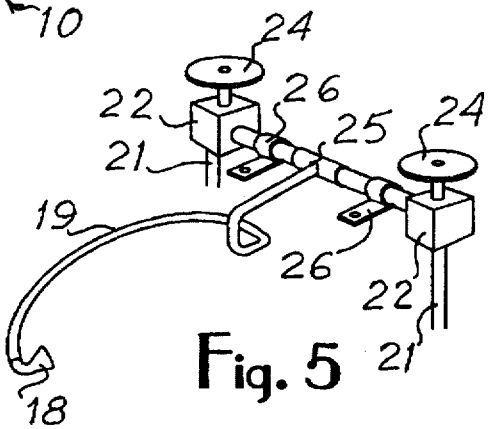

The bidet fittings of the present invention are installed on the water closet shown in FIG. 1, and are shown separately in FIG. 5. It will be noticed that the spray nozzle 18 is at the front of the bowl 10, and the delivery pipe 19 extends around the bowl, under the rim 12. The rim 12 is partially broken away to show the delivery pipe 19.

At the rear of the bowl 10, the delivery pipe 19 extends upwardly, and passes around the rim 12 to lie on top of the platform 15. As here shown, the pipe 19 is connected by means of a tee 25 to the water supply 20. The water supply 20 is fixed to the platform 15 as will be discussed later. There is a valve, such as the valve 22, at each end of the water supply 20, each valve having a handle for control of the valve, such as the handle 24. In FIG. 1, one handle 24 has been omitted to show the valve 22, but the construction is the same on both sides as is shown in FIG. 5.

The conventional water closet includes hinge means at the rear of the seat 11 for allowing pivoting of the seat 11. Such a hinge means is conventionally held to the water closet by a pair of bolts that extend through the platform 15. This construction is sufficiently well known that it will be well understood without illustration. The present invention includes a pair of brackets 26 for securing the supply pipe 20 to the platform 15. It is contemplated that the brackets 26 will be fixed by means of the bolts holding the seat hinge means.

From the above and foregoing discussion it will be understood that the water supply 20 will be connected to a convenient source of water, either cold, or cold and hot. The source of water is brought by pipes 21 to the valves 22 which can be conveniently controlled by a person sitting on the seat 11. When a valve 22 is opened, water will flow to the tee 25, through the delivery pipe 19, and to the nozzle 18. By adjusting the two handles 24, the user can adjust the temperature of the water as desired.

It will be recognized that most water closets are made of a ceramic, or porcelain, and it is not easy to attach material to porcelain without damaging the porcelain. The present invention therefore provides unique means for easily fixing the delivery pipe 19 under the rim. Those skilled in the art will understand that virtually all conventional water closets made in the U.S.A. have a plurality of holes under the rim. One such hole is illustrated at 28 in FIG. 2. The holes 28 connect the water channel 29 to the bowl 10. Thus, when the water closet is flushed, water flows through the channel 29, and into the bowl 10 through holes 28 spaced around the bowl, so the entire bowl is well flushed.

Figure 2:
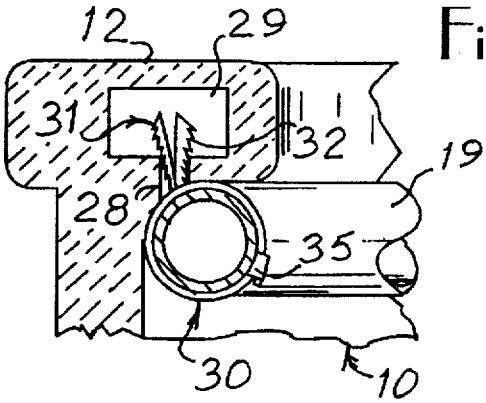
FIG. 2 is an enlarged cross-sectional view taken substantially along the line 2—2 in FIG. 1.

In FIG. 2 it can be seen that the delivery pipe 19 is placed under the rim 12. The pipe 19 is held in place by a fastener 30 that encircles the pipe 19, and has anchor portions 31 extending through a hole 28 and into the channel 29. It will be noticed that the anchor portion 31 is formed with teeth, or barbs, 32, so the anchor portion will be easy to insert into the hole 28, but will be difficult to remove. A reasonable number of fasteners such as the fastener 30 will be spaced along the length of the delivery pipe 19. It will be understood that, even though water flow through some of the holes 28 will be reduced, there is a sufficient number of such holes that adequate water flow will remain.

Figure 3:
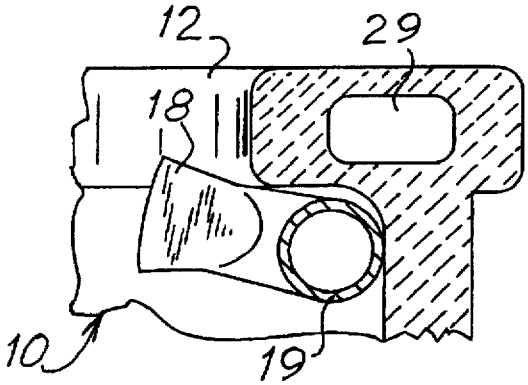
FIG. 3 is an enlarged cross-sectional view taken substantially along the line 3—3 in FIG. 1.

FIG. 3 of the drawings shows the nozzle 18. It is contemplated that the delivery pipe 19 will be formed of copper tubing or the like, the tubing being malleable, which is referred to as "soft copper". By using such tubing, the delivery pipe 19 can be easily bent to wrap around the rim 12 at the rear of the bowl, and shaped to conform to the side of the bowl 10. The nozzle 18 at the end of the pipe 19 will preferably be a manufactured item that can be soldered onto the end of the tubing. The nozzle 18 will have a right angle bend, and flattened sides as shown. This will provide a spray of water that is fan shaped, and extending vertically in the bowl with little horizontal spraying.

Figure 4:
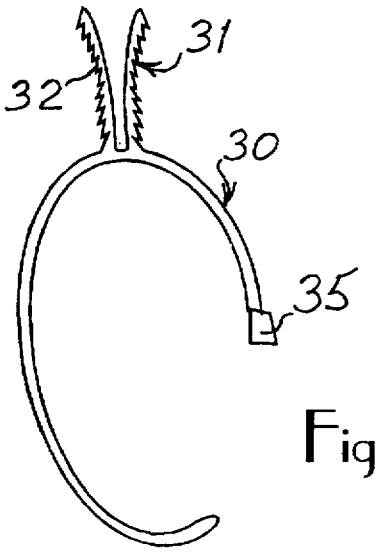
FIG. 4 is a side elevational view of a fastener made in accordance with the present invention; and, FIG. 5 is a perspective view showing the bidet fittings with the water closet omitted.

The fastener 30 is shown in more detail in FIG. 4 of the drawings. It will be understood that the strap portion 34 is made as a conventional strap fastener, the strap 34 having ratchet teeth thereon, and the locking member 35 having a pawl for engagement therewith. As a result, the strap 34 can be inserted into the locking member 35 and pulled tight, but the strap cannot be removed. Thus, the strap 34 can be passed around the delivery pipe 19 as shown in FIG. 2, and the anchor portion 31 inserted into a hole 28. The delivery pipe 19 is then secured under the rim 12.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. Bidet fittings for a water closet, said water closet comprising a bowl having a rim, a water channel in said rim, said rim defining a plurality of holes extending between said channel and said bowl, a platform at the rear of said bowl, and a tank received on said platform, said bidet fittings comprising a water supply on said platform, and at least one valve for controlling said water supply, a delivery pipe in communication with said water supply and extending around said bowl adjacent to said rim, and a nozzle disposed at the front of said bowl, said nozzle being at the terminal end of said delivery pipe, and further including fastening means for holding said delivery pipe in position, said fastening means including a strap portion encircling said delivery pipe, and an anchor portion extending into at least one hole of said plurality of holes.

2. Bidet fittings as claimed in claim 1, wherein said anchor portion includes a plurality of teeth oriented so that the said anchor portion is easily inserted into said hole and is difficult to remove from said hole.

3. Bidet fittings as claimed in claim 2, wherein said delivery pipe consists of malleable copper, and said nozzle is fixed at the terminal end of said pipe, said nozzle having flattened sides for providing a fan-shaped spray.

* * * * *